US009021754B2

(12) United States Patent
Wörmann et al.

(10) Patent No.: US 9,021,754 B2
(45) Date of Patent: May 5, 2015

(54) FOAM SEALING STRIP

(75) Inventors: Frank Wörmann, Bergkamen (DE); Markus Komma, Regenstauf (DE); Alfred Köppl, Neunburg v.W. (DE); Helmar Nauck, Berlin (DE); Jörg Birkelbach, Burscheid (DE)

(73) Assignee: Tremco Illbruck Produktion GmbH, Bodenwoehr (DE)

( * ) Notice: Subject to any disclaimer, the term of this patent is extended or adjusted under 35 U.S.C. 154(b) by 556 days.

(21) Appl. No.: 12/991,488

(22) PCT Filed: Apr. 20, 2009

(86) PCT No.: PCT/EP2009/054655

§ 371 (c)(1),
(2), (4) Date: Feb. 1, 2011

(87) PCT Pub. No.: WO2009/138311

PCT Pub. Date: Nov. 19, 2009

(65) Prior Publication Data

US 2011/0120038 A1 May 26, 2011

(30) Foreign Application Priority Data

May 13, 2008 (DE) ..... 102008023375
Dec. 10, 2008 (DE) ..... 102008055505
Mar. 13, 2009 (DE) ..... 102009013107

(51) Int. Cl.
*E06B 1/04* (2006.01)
*E04B 1/68* (2006.01)
*E06B 1/62* (2006.01)

(52) U.S. Cl.
CPC ..... *E04B 1/6812* (2013.01); *E06B 2001/626* (2013.01)

(58) Field of Classification Search
CPC ..... E04B 1/6812; E04B 1/62
USPC ..... 52/213–217, 717.01, 717.02
See application file for complete search history.

(56) References Cited

U.S. PATENT DOCUMENTS 1,640,595 A * 8/1927 Buss ..... 52/216
3,156,022 A * 11/1964 Schlegel ..... 52/215

(Continued)

FOREIGN PATENT DOCUMENTS

DE 9105612 U1 5/1991
DE 9105612.8 8/1991

(Continued)

OTHER PUBLICATIONS

International Search Report for International Application No. PCT/EP2009/054655, dated Aug. 6, 2009.

(Continued)

*Primary Examiner* — Mark Wendell
(74) *Attorney, Agent, or Firm* — Calfee, Halter & Griswold, LLP

(57) ABSTRACT

The invention relates to a foam sealing strip (2, 2', 2") which is suitable for sealing, for example, a window frame (5) and which is impregnated for delayed elastic recovery, wherein the foam sealing strip (2, 2', 2") has, with reference to a cross section, two opposite narrow sides (3, 4) which, in the fitted state, each face the inner side or the outer side of the window frame (5), and wide sides suitable for bearing against the side of the window or soffit (6), wherein, furthermore, in the fully recovered state, at least one edge region of the cross section, which edge region is designed as a vertical region (15), is at a greater height from a base surface (F) provided on the wide side than an adjoining low-lying region in the width direction, wherein the vertical region and the low-lying region run in alignment with a longitudinal direction of the foam sealing strip (2, 2', 2") and, in the fully recovered state, a surface profile which is curved in cross section is provided on the surface opposite the base surface (F). For an advantageous configuration, the base surface (F) can be a flat surface and/or a tiered increase thereof can be provided by an impregnated foam sealing strip (2) and/or two edge regions designed as vertical regions can be provided.

17 Claims, 7 Drawing Sheets

(56) References Cited

U.S. PATENT DOCUMENTS

| | | | | | |
|---|---|---|---|---|---|
| 3,703,063 | A | * | 11/1972 | Budich et al. | 52/213 |
| 4,293,173 | A | * | 10/1981 | Tricca | 439/148 |
| 4,453,855 | A | * | 6/1984 | Richter et al. | 52/717.02 |
| 4,977,018 | A | | 12/1990 | Irrgeher et al. | |
| 5,072,952 | A | * | 12/1991 | Irrgeher et al. | 277/652 |
| 5,119,609 | A | * | 6/1992 | Tait et al. | 52/213 |
| 5,686,174 | A | | 11/1997 | Irrgeher | |
| 6,308,475 | B1 | * | 10/2001 | Crish et al. | 52/215 |
| 6,418,688 | B1 | * | 7/2002 | Jones, Jr. | 52/396.04 |
| 6,672,597 | B1 | | 1/2004 | Irrgeher et al. | |
| 6,910,310 | B2 | * | 6/2005 | Bower et al. | 52/717.01 |
| 7,526,897 | B2 | * | 5/2009 | Collins | 52/217 |
| 8,402,716 | B2 | * | 3/2013 | Tinianov et al. | 52/204.62 |

FOREIGN PATENT DOCUMENTS

| | | | |
|---|---|---|---|
| DE | 4123647 | A1 | 12/1992 |
| DE | 69520786 | T2 | 4/1996 |
| DE | 29813307 | U1 | 1/2000 |
| DE | 10037097 | A1 | 2/2002 |
| DE | 10202160 | A2 | 7/2003 |
| DE | 102004024249 | A1 | 5/2004 |
| DE | 102004024251 | A1 | 5/2004 |
| DE | 102008020955 | A1 | 11/2009 |
| EP | 0976882 | A2 | 2/2000 |
| EP | 1131525 | B1 | 3/2004 |
| EP | 1811111 | A2 | 7/2007 |
| EP | 2112292 | A2 | 10/2009 |
| EP | 1811111 | A3 | 5/2010 |
| WO | 95/21700 | A1 | 8/1995 |
| WO | 01/21921 | A1 | 3/2001 |

OTHER PUBLICATIONS

Written Opinion of the International Searching Authority for International Application No. PCT/EP2009/054655, dated Aug. 6, 2009.
International Preliminary Report on Patentability for International Application No. PCT/EP2009/054655, dated Sep. 20, 2010.
Third Party Submission filed by Jochen Wachter in counterpart EP Appln. No. 09745644.6, dated Dec. 21, 2013.
Notice of Requisition by the Examiner (National Examination Report) in counterpart CA Appln. No. 2724225 dated Feb. 5, 2014.

* cited by examiner

E
2"
8
7
4
3
H
10
9
14
E
2"
9
15
15
B 8
7
F
F
4
3
h
H
15
14
2"
15
B 4
7
5
2"
6
3

FOAM SEALING STRIP

CROSS REFERENCE TO RELATED APPLICATIONS

The present application is the U.S. national phase entry of PCT/EP2009/054655 with an international filing date of Apr. 20, 2009, which claims the benefit of German Patent Application Nos. 102008023375.7 filed on May 13, 2008; 102008055505.3 filed on Dec. 10, 2008 and 102009013107.8 filed on Mar. 13, 2009, the entire disclosures of which are incorporated herein by reference.

The invention relates to a foam sealing strip which is suitable for sealing a window frame against a reveal and which is impregnated for delayed recovery, the foam sealing strip having two opposite narrow sides, which, in the fitted state, respectively face the inner side or the outer side of the window frame, and wide sides suitable for abutting the side of the window or reveal, furthermore, in the fully recovered state, at least one edge region of the cross-section, formed as a high region, having a greater height from a base surface, provided on the wide side, than a low region adjoining in the direction of the width, the high region and the low region running in alignment with a longitudinal direction of the foam sealing strip and, in the fully recovered state, a surface profile which is curved in cross-section being provided on the surface opposite from the base surface.

Foam sealing strips of this type have already become known in various configurations. In particular, reference is made to EP 1 811 111 A2; in addition for instance to EP 1 131 525 B1. In the case of the foam sealing strip known from the first-cited document, a strip element or a foam strip is inserted such that it is associated with one narrow side and alters the form of a base surface of the foam sealing strip, the base surface associated with a self-adhesive layer, in such a way that there results an increase, associated with one narrow side, in the height of the foam sealing strip, that is to say a greater compression in the fitted state.

On the basis of the cited prior art, it is an object of the invention to provide a foam sealing strip which allows a differing compression of the sealing strip over the width to be advantageously achieved in the fitted state.

A possible solution achieving this object is given by a first concept of the invention in the subject matter of Claim 1, it being provided that the base surface is a planar base surface extending over the entire width and formed by the one-piece cross-section of the foam itself. The fact that the cross-section produced as a single part in this way extends from a planar base surface, but nevertheless has in cross-section a curved profile on the upper side, means that it can be advantageously produced in a simple manner. Moreover, the curved profile of the surface can allow it to be achieved that continuous abutment is nevertheless also obtained in the fitted state. A continuous transition with regard to the differing compression over the width is obtained.

A possible further solution achieving the stated object is given by a further concept of the invention in the subject matter of Claim 2, it being provided that the greater height extends from a planar base surface and in that the high region is achieved by a first impregnated foam sealing strip, forming the low region, being built up in a tiered manner by a second impregnated foam sealing strip. Here, the second foam sealing strip producing the tiered build-up may also be formed in such a way in cross-section, with a sloping surface or rounded shape, that a continuous transition with regard to the compression over the direction of the width is obtained in the fitted state. A rectangular configuration of this second foam sealing strip, optionally also of the first sealing strip, may also be provided, as also still to be explained further below. The fact that two sealing strips impregnated for delayed recovery are disposed one on top of the other in a tiered manner allows a foam sealing strip that forms the low region to be used either as such or in the built-up state in a manner that is simple in terms of production and indeed variable according to requirements. The adhesive bonding to the second foam sealing strip in the sense of the building-up mentioned can be easily carried out. Moreover, it may also be advantageous to use different impregnations for the first and second foam sealing strips. If, for instance, the second foam sealing strip is impregnated more, this can achieve the effect that the recovery of this second foam sealing strip takes place with a greater delay than the recovery of the first foam sealing strip. Furthermore, it is also preferred that, with the preferred one-piece form of the first foam sealing strip, this first impregnated foam sealing strip itself forms the planar base surface.

A further possible solution achieving the stated object is given according to a further concept of the invention in the subject matter of Claim 3, it being provided that, in the fully recovered state, two edge regions of the preferably one-piece cross-section that are formed as high regions have a greater height than a low region located between the high regions in the direction of the width, the high regions and the low region running in alignment with a longitudinal direction of the foam sealing strip. Accordingly, the cross-section of the sealing strip, or in actual fact of the foam of the sealing strip, in the fully recovered state is higher at least where it is associated with an edge region than in the low region adjoining in the direction of the width. The non-uniform compression over the width that is desired in the fitted state (with assumed approximately uniform size of gap in this direction of the width of the foam sealing strip) is achieved by a cross-sectional configuration of the foam itself that deviates from a rectangular or square shape of the cross-section.

There is no need for a strip element or separate—additional—foam strip that is present in the fitted state. Rather, in the fitted state there is provided just one directly contiguous foam strip, as one part, but in fact non-uniformly compressed. In the direction of the narrow sides, the sealing strip is homogeneously formed. Over the width of the sealing gap or, in the fully recovered state, in the direction of recovery of the sealing strip, the foam is in each case uniformly formed and the impregnation is also in each case uniformly performed.

The designations of the outer surfaces of the foam sealing strip as wide sides or narrow sides are chosen with regard to the conventional geometry in the fitted state. The wide side is (when viewed in cross-section) the dimension extending in the depth of the gap (for example perpendicularly to the plane of a window frame) and the narrow side is the dimension extending in the width of the gap (in the case of the example in the plane of the window frame). In principle, however, a narrow side may also have a greater dimension than a wide side.

Further features of the invention are explained below, including in the description of the figures, often in their preferred association with the concept of the claims already discussed above, but they may also be important in association with just one or more than one feature of these claims or independently, or in a different overall concept.

Furthermore, it is preferably provided that the low region has a dimension which is one or more of the dimension of a wide side, that is to say the dimension of the width of the sealing strip. In particular, it is preferred that the low region has a dimension which is up to nine-tenths of the dimension of a wide side.

With respect to the stated range of the dimensioning of the low region, that is to say from one-tenth to nine-tenths, all intermediate values are also included here in the disclosure, in particular in 1/10 increments of the dimension of the width.

The formation of the foam sealing strip in cross-section may be unsymmetrical; that is to say, as also described above in principle, such that a high region is provided—but then also preferably only one—to be precise preferably at an edge. This configuration is suitable in particular with regard to being used for achieving greater vapor impermeability on one side, generally the inner side in the fitted state, as is known from the document EP 1 811 111 A2, cited at the beginning. On the other hand, a configuration with two high regions spaced apart by a low region may also be advantageous; for instance also configured in such a way that the sealing strip has in cross-section a U-profiling that results in the central depression. The two high regions correspond here to the U-legs.

Specifically, it may also be preferred that the sealing strip is formed symmetrically with respect to a central plane extending transversely in relation to a wide side.

With reference to a fully recovered state, it is also preferred that a height of the low region corresponds to 20 to 80%, preferably 60 to 70%, of the height of the high region. Here, the height is the dimension measured from the base or from a self-adhesive strip in the direction of the narrow sides or in the direction of expansion. With regard to the stated ranges, all intermediate values, in particular in 1/10% increments restricting the range from the lower and/or upper limit to the other limit, respectively, are also included.

The transition, seen in cross-section, from a high region to a low region may be curved or straight. Here, the straightness may take the form of a perpendicular to a wide side, but the straightness may also enclose an acute angle with a perpendicular to the wide side. An angle in the range from 5 to 60° is preferred, all intermediate values also being intended to be regarded as hereby included in the disclosure, to be precise in particular in increments of 0.5° restricting the range from the lower and/or upper limit to the other limit, respectively, or in the sense of singular numbers of degrees. A combination of a straight profile and a curved profile may also be provided.

With regard to a curved surface profile, it is also preferred in particular that the line of curvature has a point of inflection in cross-section.

Where two foam sealing strips are disposed one on top of the other, adhesive bonding thereof is particularly preferred.

It is also preferred that the high region or the built-up second foam sealing strip is in alignment with a side surface of the first foam sealing strip.

If adhesive bonding is provided, it is furthermore also preferred in particular that a scrim is disposed in the bonding region between the first foam sealing strip and the second foam sealing strip.

It is also particularly preferred that the high region, in particular a high region that results in a vapor impermeability differing from the side regions, is made to be of a different color than the low region. This can also be carried out particularly advantageously in the case of two foam sealing strips disposed one on top of the other in a tiered manner. This coloring may, for instance, serve the purpose of being used as a fitting aid, since in this respect positionally correct fitting can be ensured. The greater impermeability must be provided on the inner side toward the room.

In the fully recovered state, a high region may have a height, measured from a base surface, which corresponds to half to 1.5 times a widthwise extent of the sealing strip (overall). This range also includes all intermediate values, where they are not in any case specified by way of example, as being disclosed, to be precise in particular in 1/10 increments restricting the range from the lower and/or upper limit to the other limit, respectively, or in the sense of singular values.

In the case of a formation with two high regions located next to one another in the direction of the width, the fully recovered height of the foam sealing strip in the high region preferably corresponds to 0.25 to 0.75 of the width of the sealing strip. Also in this respect, all intermediate values are included in the disclosure, as specifically stated above.

It is also possible that the foam sealing strip has in the packed state a uniform compression over its width. The fact that there is uniform compression in the packed state means that uniform recovery is also obtained in the course of fitting into the on-site gap. The foam sealing strip "grows" to the same extent over its entire side in the course of the recovery. It is virtually imperceptible that the high region recovers somewhat more quickly. Moreover, on account of this measure, an advantageous one-piece form of the foam sealing strip can also be provided. Said uniform compression, i.e. that the degree of compression in the packed state is the same in each case over the width in spite of differing heightwise extent of the foam strip over the width in the fully recovered state, can be achieved in principle for instance by appropriately adapted packing, which follows over the width of the foam strip the—uniformly—compressed contour thereof; for instance formed by an insert part of hard material, such as for instance hard plastics. In the case of the "stick" packing variant that is also possible in principle, that is to say in the form of an elongate strip-shaped part, the packing itself may also be provided in this contour, for instance by the covering being formed as a corresponding covering of hard material with a cross-sectional contour following the correspondingly structured surface of the foam sealing strip.

It is preferred in particular in this connection that the uniform compression in the packed state is achieved by an insert part associated with the region having a lower height in the fully recovered state, that is to say the low region. This insert part may be a strip-shaped part, as is also already known in principle from the document EP 1 811 111 A2, cited at the beginning. However, it is merely inserted so that it can be removed at any time after release of the recovery, and is also intended to be removed as and when required. The insert part merely rests on the sealing strip; it is not bonded to it. If, as preferred, the foam sealing strip has a self-adhesive layer (on the rear side, associated with the window frame), the insert part is preferably disposed on the surface of the foam sealing strip that is facing away from the self-adhesive layer. The surface of the foam sealing strip on which the insert part is disposed is accordingly preferably (solely) the surface of the low region.

The insert part may, in principle, also be a foam part. The foam part, which may also be a hard foam part, is formed with regard to its elasticity and ability to recover its shape in such a way that, on account of its size, it produces the desired uniform compression of the foam sealing strip in the packed state over the entire width. The insert part need not necessarily be completely removable. It may also be provided merely in such a way that it can, for example, be swung out.

In particular, the uniform compression of the foam sealing strip over the width may be obtained by two identical foam sealing strips disposed such that they overlap one another at least partially and are directed in opposite directions. Directed in opposite directions means here that the regions of greater height, the high regions, face in opposite directions. With regard to partial overlapping, on the one hand only the regions of lower height, the lower regions, may be disposed one on top of the other. On the other hand, however, foam sealing strips of this type may also be disposed such that they lie one on top of the other as a whole, i.e. overlapping completely.

It is particularly preferred, however, that the insert part consists of a biodegradable material. This is with a view to the insert part being removed from the foam sealing strip, or in any event from the region on which it lay in the packed state, before said strip is fitted, by contrast with the additional part as provided in the case of the subject matter of the aforementioned EP 1 811 111 A2. It is specifically not also fitted, or in any event not completely or not as it is arranged when in the packed state. Preferably, it is completely removed and disposed of as scrap.

In the case of a biodegradable material, it can readily be disposed of on the construction site or else just carelessly thrown away. It does not then lead to contamination or environmental problems.

Various embodiments are specifically suitable as biodegradable materials. For example, reference may be made to elements produced on the basis of rye meal. For example, a solid part that is advantageous for the purpose for which it is used here can be achieved on the basis of rye wholemeal, water, fine-grained additives such as diatomaceous earth and lime, wood fibers in baled form or jute fabric, preferably also by foaming. In this respect, reference may be made, for instance, to the disclosure in DE 102004024251 A1; also for instance to DE 102004024249 B1.

It may, in particular, also be a biodegradable plastic which is based on meal as the main component, the meal once again being obtained by milling fractionation from rye. The material is then in the form of granules, which can be worked in plastics extrusion machines or plastics injection-molding machines. In its finished form, the worked material then preferably has a foamy character. In particular, it may be a material such as that known under the trade name GETREX.

In particular, the insert part may also be a cut-to-size part, which is therefore cut for example from a wider part.

The invention is further explained below with reference to the accompanying drawing, which however merely represents an exemplary embodiment and in which.

Figure 1:
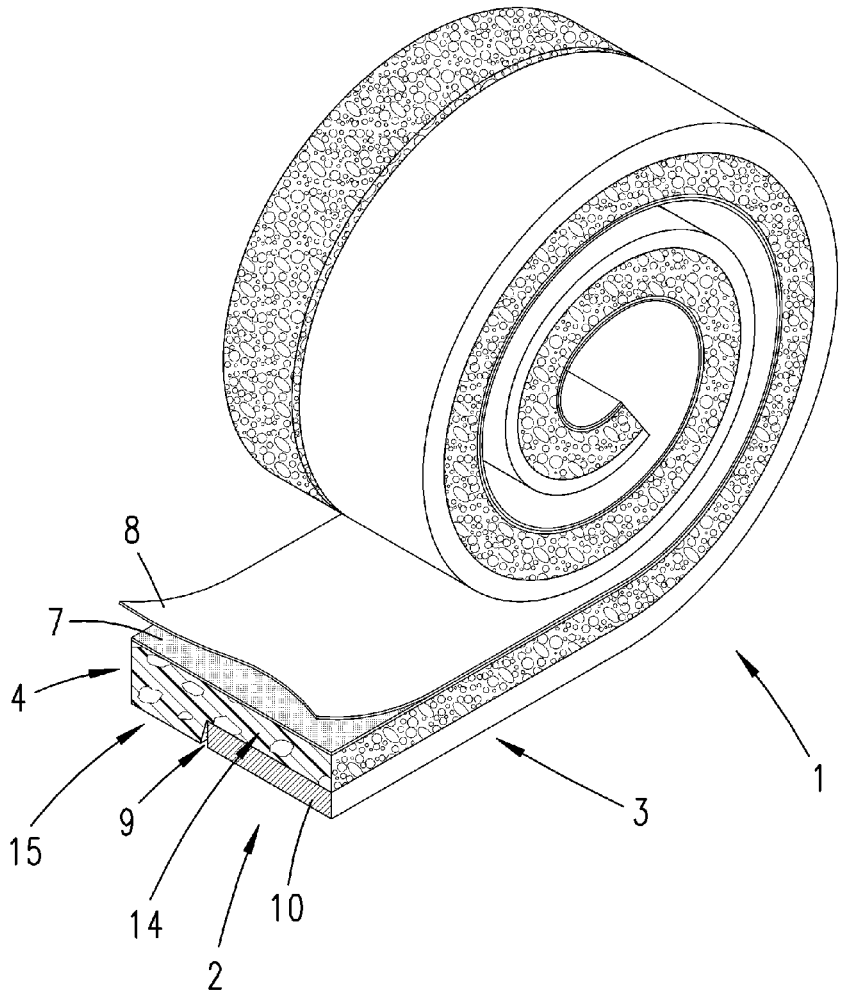
FIG. 1 shows a perspective, schematic view of a foam sealing strip wound up into a roll.
Figure 2:
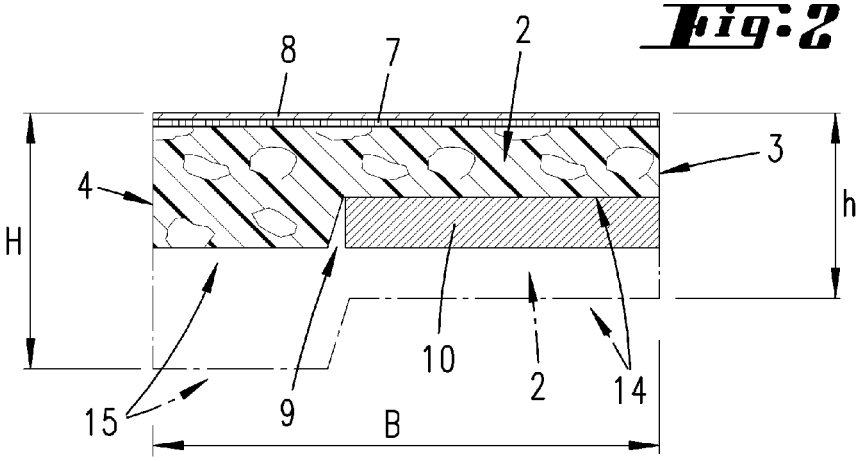
FIG. 2 shows a cross-sectional view of the foam sealing strip according to FIG. 1 with the state of full recovery represented by chain-dashed lines.
Figure 2A:
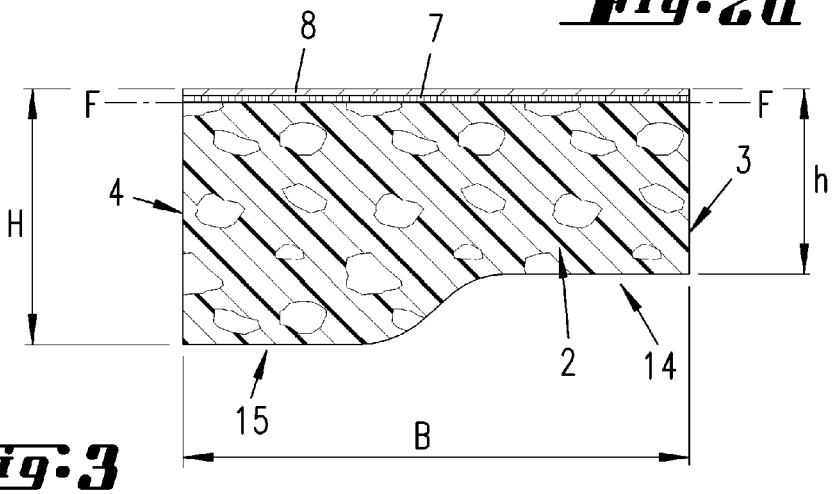
Figure 3:
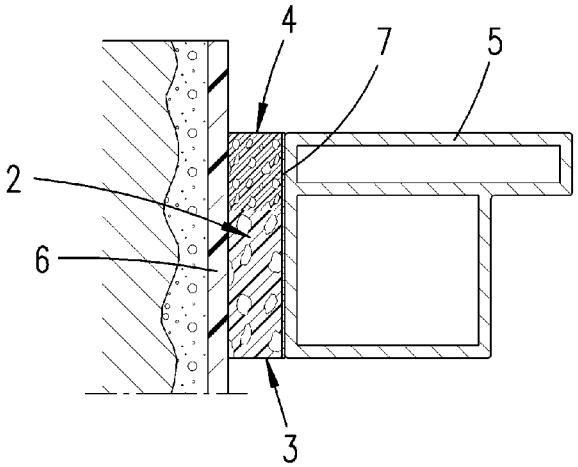
Figure 4:
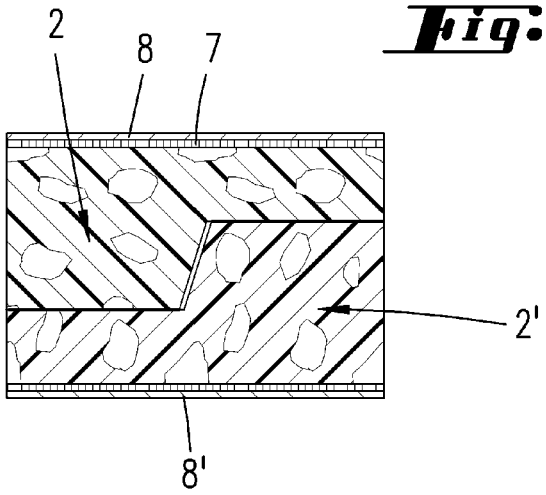
Figure 5:
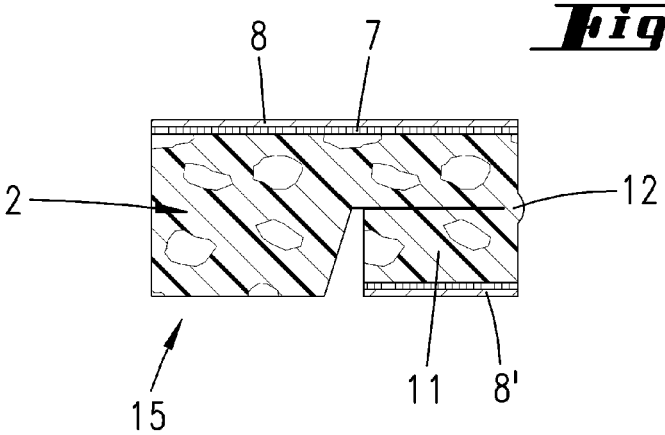
Figure 6:
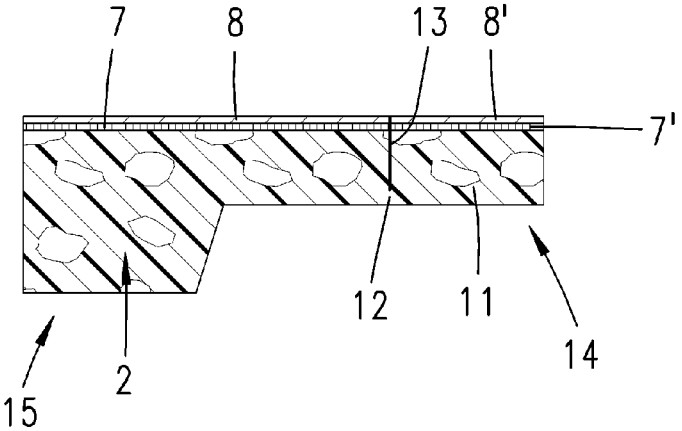
Figure 7:
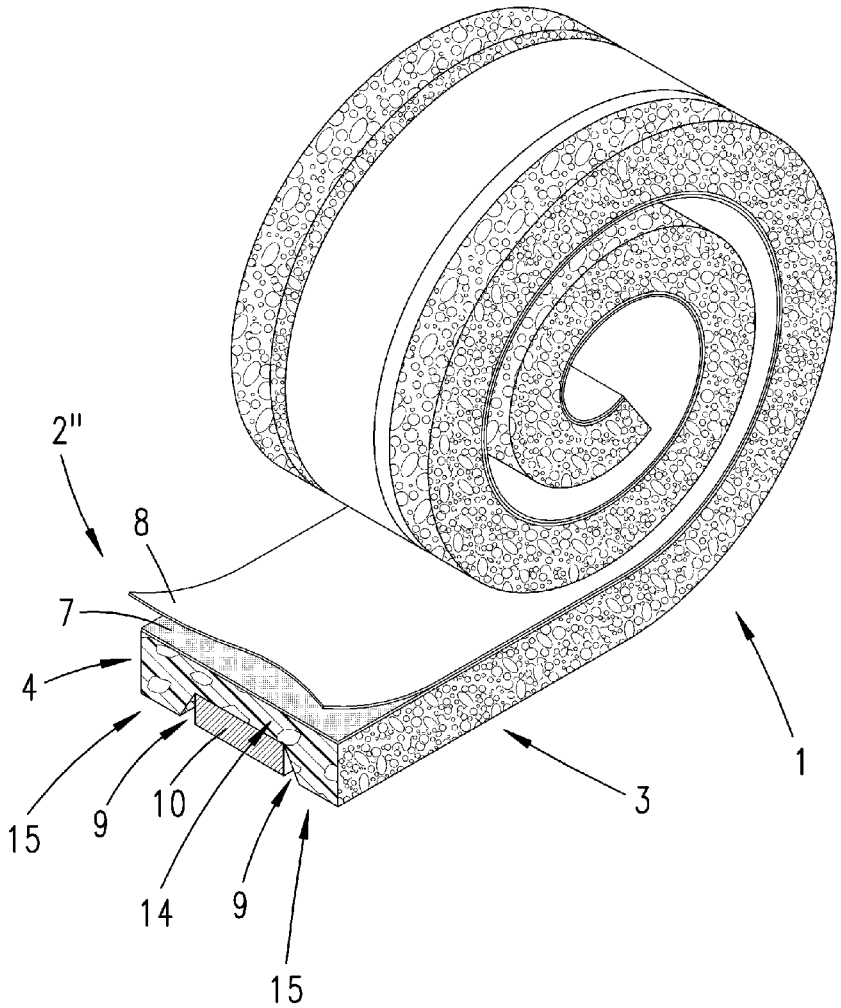
Figure 8:
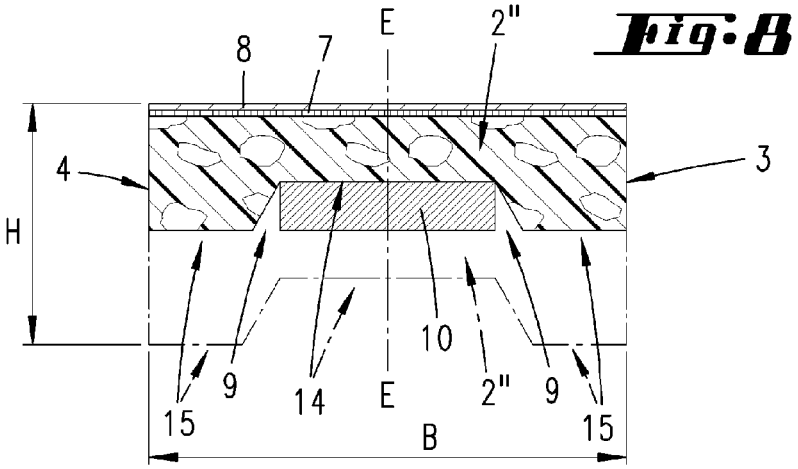
Figure 8A:
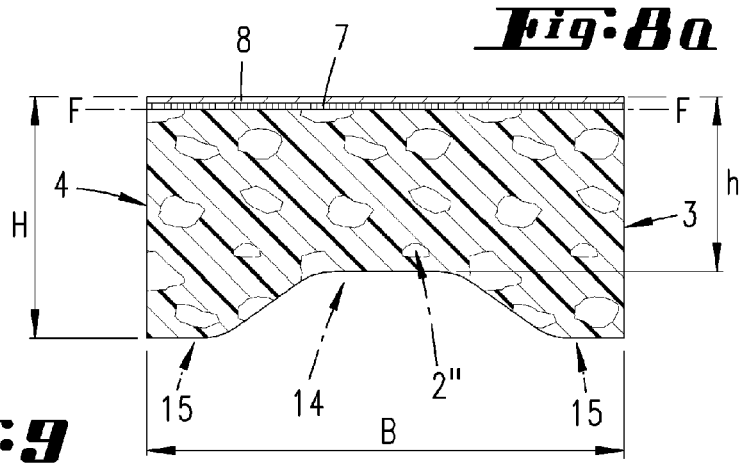
Figure 9:
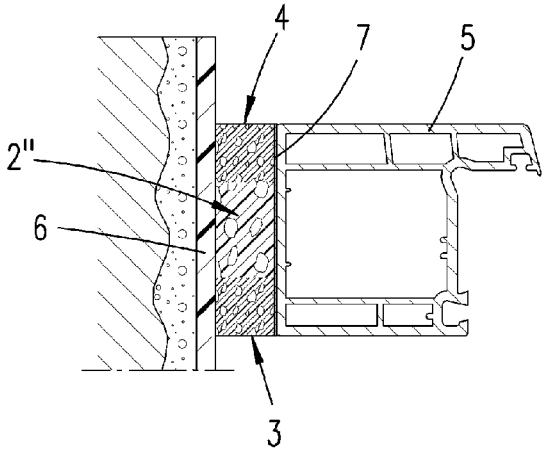
Figure 10:
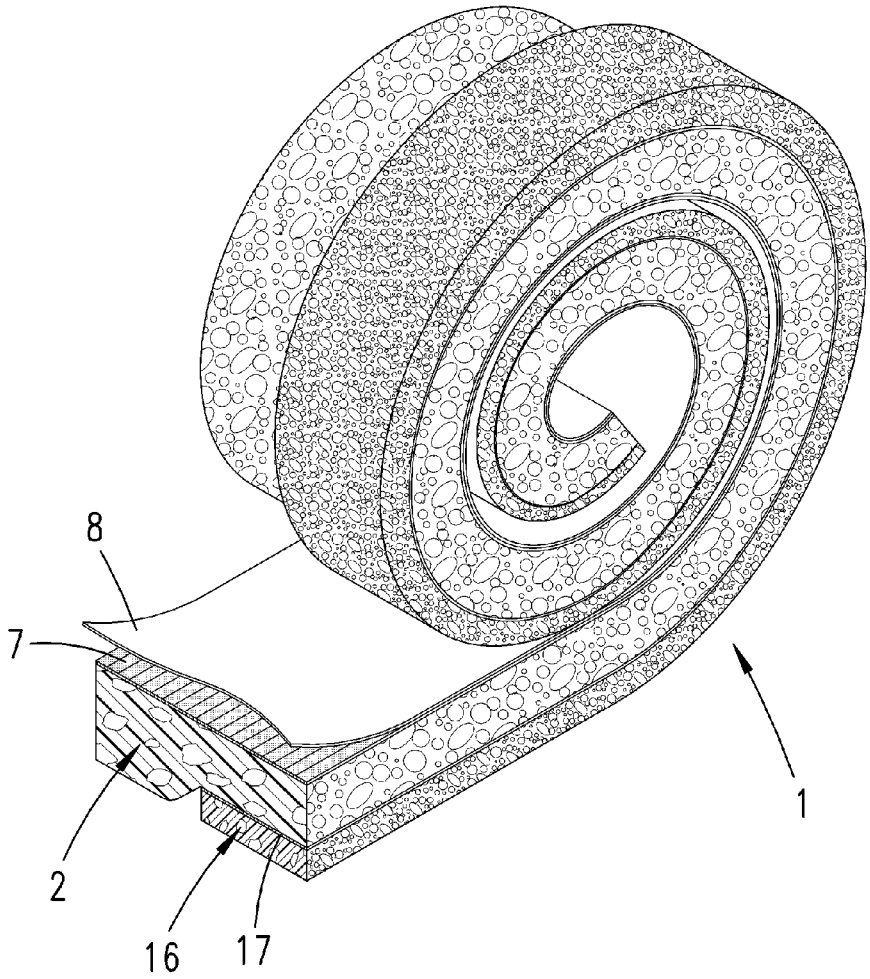
Figure 11:
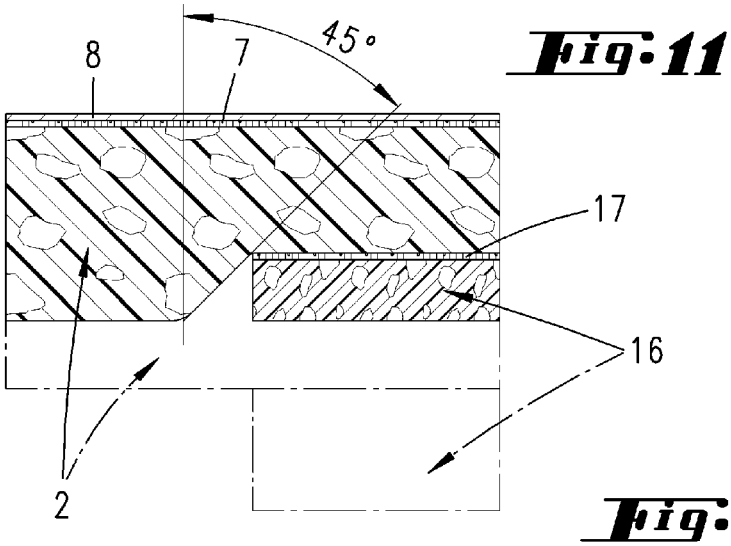
Figure 11A:
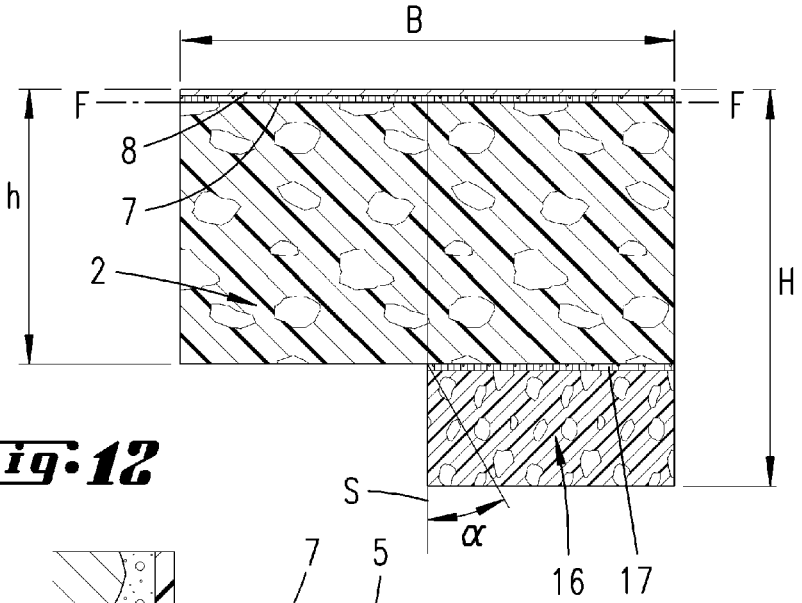
Figure 12:
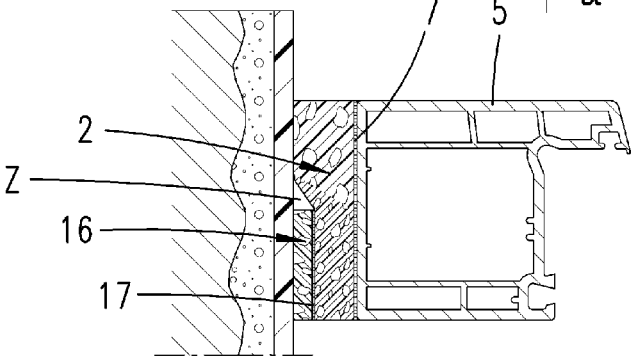

FIG. 2*a* shows an embodiment modified with regard to the contour;

FIG. 3 shows the subject matter according to FIG. 1 or FIG. 2 in the fitted state;

FIG. 4 shows a basic sectional representation of two foam sealing strips disposed such that they lie one on top of the other, in opposite directions;

FIG. 5 shows a schematic representation corresponding to FIG. 4 of a foam sealing strip with a hinge-connected insert part;

FIG. 6 shows a representation of the foam sealing strip according to FIG. 5, in the swung-back state;

FIG. 7 shows a representation corresponding to FIG. 1, but with the foam sealing strip formed with two high regions;

FIG. 8 shows a representation corresponding to FIG. 2 of the foam sealing strip according to FIG. 7;

FIG. 8*a* shows an embodiment modified with regard to the contour;

FIG. 9 shows a representation corresponding to FIG. 3 of the foam sealing strip according to FIG. 7;

FIG. 10 shows a representation corresponding to FIG. 1 or FIG. 7, in a form of a foam strip with two foam sealing strips disposed one on top of the other in a tiered manner;

FIG. 11 shows a representation corresponding to FIG. 2 or FIG. 8 of the foam sealing strip according to FIG. 10;

FIG. 11*a* shows an embodiment modified with regard to the contour as compared with the representation according to FIG. 10 or 11; and FIG. 12 shows a representation of the fitted state of the foam sealing strip according to FIG. 10 or FIG. 11.

Shown and described, in first instance with reference to FIG. 1, is a foam sealing strip 2 wound up into a roll 1, which in the supplied or packed state, for instance wound up into a roll as represented in FIG. 1, has a non-uniform profile over the width (without the insert part 10). The foam sealing strip 2 may, however, also be wound up into a roll without the insert part 10. In this case, it has on the roll a rectangular or approximately rectangular profile. The foam sealing strip 2 (also) has in the fully recovered state, see FIG. 2 or FIG. 2*a*, a (geometrically similar) profile that is non-uniform over the width. Associated with a first narrow edge side 3, there is a smaller height h (thickness), that is to say a low region 14 is formed, and associated with a second narrow edge side 4 there is a greater height H (thickness), that is to say a high region 15 is formed. The high region 15 and the low region 14 are formed in alignment with a longitudinal direction of the foam sealing strip. Over the length of the foam sealing strip 2, there is always the same cross-sectional profile. Since, in the fitted state, see FIG. 3, a maximum expansion of the foam sealing strip 2 that is virtually the same over the width of the sealing gap (dimensions perpendicular to the plane of an intended window frame for example) is predefined on account of the given sealing gap between a window frame 5 and a reveal 6 that is virtually the same over the width of the window, a higher permanent compression of the foam sealing strip is obtained in the high region 15 associated with the narrow edge side 4 (the foam sealing strip can only expand here by a smaller amount) than in the low region 14 associated with the narrow edge side 3. Here, the narrow edge side 4 is facing the interior space of a building. The desired lower vapor permeability from the inside to the outside is thus obtained. A base surface F of the foam forming the foam sealing strip has a planar profile and extends over the entire width B. This also applies, for example, to the embodiments that are still to be described below, in particular in further detail, according to FIGS. 8*a* and 11*a*.

It is possible that, in the packed state according to FIG. 1, the insert part 10, if provided, provides a compression that is uniform over the width. The insert part 10 complements the low region 14 in such a way that the outer surface of the insert part 10 is in alignment with the associated surface of the high region 15. However, at least for the dimensions given here as preferred, the height h being between 60 and 70% of the height H and open-cell flexible polymer foam being used, such an insert part has proven to be dispensable.

In FIG. 2, it is illustrated in the representation in chain-dashed lines how the foam sealing strip 2 would look (qualitatively) in the case of full expansion (the insert part 10 has then been removed). It is evident that this can be geometrically similar to the compressed state, which corresponds to the representation of FIG. 2, if a corresponding insert part 10 is used in the compressed state. However, the step between the low region 14 and the high region 15 also becomes correspondingly greater. In the compressed state, a virtually uniform degree of compression is therefore obtained, irrespective of the non-uniform profile of the foam sealing strip over the width, if an insert part is used. The ratio between the height in the fully recovered state to the height in the compressed state is then in each case the same over the width.

It is also important that the self-adhesive layer 7 desired for the fitting and the covering layer 8 located on it are formed on the wide side of the foam sealing strip 2 that is facing away from the profiling 9 of the foam sealing strip. The insert part 10 that is optionally used can therefore be easily removed and disposed of after unwinding of the foam sealing strip from the roll.

The insert part 10 is specifically such a part made of a biodegradable material, as described further above.

The high region 15, which in the case of the exemplary embodiment is associated with the narrow side 4, may extend in the direction of the width over 5% or more of the total width of the foam sealing strip; preferably up to half, that is to say 50%, of the width of the foam sealing strip. In the case of a symmetrical form, see further below, the high region 15 preferably extends up to approximately 40% or 45% of the width of the foam strip 2. The two high regions 15 may accordingly extend up to approximately 80 to 90% of the width of the foam strip 2. All intermediate values, in particular in 1/10% increments, are also included here as disclosed in the stated ranges.

It is also preferred that the greater height on one side of the foam sealing strip provided in the expanded state exceeds the height of the region of lower height by 5% or more; in particular up to 50%. In the same way, here too the intermediate values, in particular in 1/10% increments, are also included as disclosed.

The width of such a sealing strip may, for example, lie between 40 and 120 mm, but also above that. The height of the fully recovered foam may in the region of lower height (thickness) be, for example, 30 to 100 mm, or else above that. The respective intermediate values, in particular in 1/10 millimeter increments, are also included as disclosed in these stated ranges.

The cross-section of the sealing strip may (with reference to the fully expanded state) be made up of a rectangular portion (over the entire width) and a square or rectangular portion disposed on one side thereof. While both sides of the foam sealing strip that form the narrow edge sides are formed as running straight, preferably rectangularly in relation to a base surface having the self-adhesive strip, the transition from the region of greater thickness to the region of smaller thickness may be formed parallel to a narrow edge side or with a surface running at an acute angle to a narrow edge side in cross-section. It is preferred, however, that the peripheral edge forming the at least one high region and one low region has a continuous curvature, cf. for instance FIGS. 2*a* and 8*a*. However, this merely describes the geometrical form. As far as the overall cross-sectional geometry is concerned, the foam sealing strip is preferably formed as one part.

Further possible embodiments are presented with reference to FIGS. 4 and 5.

In the case of the subject matter of FIG. 4, two foam sealing strips 2, 2' are disposed one on top of the other in such a way that they are directed in opposite directions. In this cross-sectional representation, the regions of greater height are disposed such that they are lying next to one another, but facing in opposite directions. Associated with each high region there is, lying opposite, a region of lower height of the other foam sealing strip. Such a combination of identical foam sealing strips 2, 2' can be produced in the same way, wound up on a roll as a commercial product, as explained with regard to FIG. 1. In a variant, the foam sealing strips 2, 2' could also be disposed one on top of the other only in the regions of smaller height. The foam sealing strips 2, 2' complementing one another in terms of their form allow uniform compression to be achieved in the fitted state, without an insert part 10 being needed. Seen in this way, the one foam sealing strip 2 acts as an insert part for the other foam sealing strip 2', and vice versa.

The subject matter of FIG. 5 concerns a packed state, in which a subregion 11 of a foam sealing strip 2 has been swung over onto the foam sealing strip 2 in such a way that it complements the region of smaller height of the foam sealing strip 2 to form a height equal to that in the high region 15. To fit such a foam sealing strip 2, the region 11 may be swung back again, so that the configuration according to FIG. 6 is obtained, which is at the same time also the starting configuration before the packed state according to FIG. 5. Of course, the covering layer 8 or 8' must also be peeled off for the actual fitting. In terms of production, for this purpose a separating cut 13 that does not cut through has been made in an integral starting product (FIG. 6). The separating cut 13 has also divided the covering layer 8 and the self-adhesive layer 7 into subregions 8, 8' and 7, 7', respectively. This embodiment also allows uniform compression in the packed state to be achieved, without additional parts such as for instance an insert part 10 being needed.

The integral connection of the two hinged parts of the foam sealing strip provided by the remaining web 12 represents an embodiment which could also be modified by the parts being completely cut through, or a different or other foam part 11 being placed onto the foam sealing strip in the packed state in a manner corresponding to FIG. 5. Such a different or other foam part also would not necessarily have to have a self-adhesive layer 7' and/or a covering layer 8'.

The embodiment of FIGS. 7 to 9 shows a foam sealing strip 2", which has two high regions 15 and a low region 14. The high regions 15 are spaced apart here by the low region 14—with reference to a cross-sectional representation, see for instance FIG. 8. Such a configuration is particularly advantageous whenever a differing vapor permeability of the side regions is not a prime concern, although this can be achieved here by a nevertheless differing heightwise extent of the high regions 15, for instance, or corresponding impregnation (cf. EP 1 811 111 A2). In the fitted state, the low region 14 can achieve a higher insulation value, so that in spite of the comparatively high sealing force in the side regions, a comparatively high thermal resistance value, that is to say a high thermal insulation value, can be achieved.

FIG. 8*a* shows the preferred curved profile already mentioned.

Otherwise, the situation is in principle the same as in the case of the previously described embodiments. Once again an insert part 10 may be inserted in the low region 14, in order to obtain uniform compression over the cross-section of the foam sealing strip 2" in the packed state, that is to say preferably like a roll 1, cf. FIG. 7. The high regions 15 and the low region 14 extend in alignment with the longitudinal direction. In particular, in the case of the exemplary embodiment, there is also symmetry in relation to a central longitudinal plane E-E of the foam sealing strip 2".

In the fitted state, for instance according to FIGS. 3, 9 and 12, the high region or the two regions at the edges of higher compression as compared with the low region or the middle region of lower compression are clearly shown by different shading.

It is only for the sake of clarity that the rolls represented in FIGS. 1, 7 and 10 are illustrated with turns that are not lying against one another. The turns are usually lying closely against one another. The foam is preferably at least partially open-cell flexible foam that can elastically recover its shape; for example flexible polyurethane foam.

FIGS. 10 to 12 show an embodiment with a high region formed by building up a second impregnated foam sealing strip 16 in a tiered manner on the first impregnated foam sealing strip 2. The first foam sealing strip 2, which forms the low region, extends over the entire width of the foam sealing strip. The second foam sealing strip 16 accordingly extends only over part of the width.

The second foam sealing strip 16 is adhesively bonded to the first foam sealing strip by a self-adhesive layer 17, which is in principle a self-adhesive layer identical to the self-adhesive layer 7 already described. In addition, a scrim is also inserted in this self-adhesive layer 17, as also preferably in the self-adhesive layer 7. Furthermore, the foam sealing strip 16 is formed in a different color than the foam sealing strip 2. While the foam sealing strip 16 may, for example, have a gray color, the foam sealing strip 2 may be black.

While in the case of the representations of FIGS. 10, 11 and 12, the first foam sealing strip 2 and the second foam sealing strip 16 in each case have a rectangular cross-section in the fully recovered state, FIG. 11*a* shows a representation with a trapezoidal cross-section, only one side surface of the second foam sealing strip 16, to be specific the side surface forming the transition to the low region, being however formed in cross-section such that it runs at an angle alpha to a perpendicular S that is perpendicular to the base surface.

It is evident that such a cross-sectionally straight transition between the high region and a low region is also provided in the case of the embodiments of FIGS. 1, 2 and 4 to 8.

In FIG. 8*a*, such a straight transition is also provided in principle, but here with clearly curved end regions, which produce the actual transition to the low region and to the plane of the high region.

With reference to FIG. 12, it can be gathered that it is possible in the case of an embodiment according to FIG. 10 or FIG. 11, that is to say generally also in the case of a correspondingly straight transition, that a triangular region Z that is not filled with foam occurs in the fitted state. This triangular region is shown exaggerated in size here. A certain air cushion that can have an advantageous effect is achieved in this region.

With respect to the embodiment of FIGS. 10 to 12, it may also be advantageously provided that the second foam sealing strip 16 consists of a different material, for example of less or more open-cell material, than the first foam sealing strip 2.

It is also of importance that, in the case of the embodiments represented, the base surface F, as represented merely by way of example in FIGS. 2 and 2*a*, is a planar surface which extends over the entire width of the base surface given. With reference to this base surface, the cross-sectionally curved or straight transition between a high region and a low region is obtained, as already described. In particular, in the case of a curved profile, such a curvature may be provided that a point of inflection is obtained, as revealed for instance by the representation of FIG. 2*a*.

A fully recovered height H of the foam sealing strip preferably corresponds to half to 1.5 times the width B of the sealing strip, for example is the same as the widthwise extent B. This clearly concerns all the embodiments, in particular the embodiments of FIGS. 2*a*, 8*a* and 11*a*.

All features disclosed are (in themselves) pertinent to the invention. The disclosure content of the associated/accompanying priority documents (copy of the prior patent application) is also hereby incorporated in full in the disclosure of the application, including for the purpose of incorporating features of these documents in claims of the present application.

The invention claimed is:

1. An impregnated foam sealing strip for sealing a window frame, the foam sealing strip comprising:

two opposite narrow sides, defining a height, that in a fitted state, respectively, face one of an inner side and an outer side of the window frame; and two wide sides, defining a width, suitable for abutting a side of the window and a reveal, respectively, in a recovered state, at least one of the narrow sides being formed as a high region having a greater height from a base surface on one of the wide sides than a height of a low region, the high region and the low region being joined in a direction of the width, the high region and the low region running in alignment with a longitudinal direction of the foam sealing strip and, in the recovered state, a surface profile which is curved in cross-section and formed in a tiered manner between the high region and the low region being provided on the surface opposite from the base surface to form the high region and the low region as a single and unitary part, and the base surface being a planar surface and extending over the entire width, the foam sealing strip being a compressible material that is compressible under a pressure and that recovers to the recovered state when the pressure is released, the foam being impregnated for delayed recovery to the recovered state when the pressure is released, the base surface being formed by the impregnated foam, the low region height being between 60% and 80% of the high region height so that a height of the curved surface profile is between 40% and 20% of the height of the high region, and the low region having a dimension which is one-tenth to four-tenths of the width of the wide sides, the foam sealing strip being adapted to be compressed in a uniform sealing gap between two surfaces in a final assembled state, such that the high region, the low region, and the curved surface profile have substantially the same heights when the foam sealing strip is compressed between the two surfaces in the final assembled state, and a permanent compression of the foam sealing strip is greater in the high region at the narrow side than in the low region at the narrow side, thereby creating a desired lower vapor permeability from the high region to the low region.

2. A foam sealing strip impregnated for delayed recovery, for sealing a window flame, the foam sealing strip comprising:

two opposite narrow sides, which, in the fitted state, respectively face the inner side and the outer side of the window frame; and wide sides, defining a width, suitable for abutting the side of one of a window and a reveal, in a recovered state, at least one edge region of the cross-section, formed as a high region, having a greater height from a base surface, provided on the wide side, than a low region, adjoining in the direction of the width, the high region and the low region running in alignment with a longitudinal direction and joined by a surface profile which is curved in cross-section and formed in a tiered manner between the high region and the low region being provided on the surface opposite from the base surface to form the high region and the low region as a single and unitary part, the high region being achieved by a first foam sealing strip that is impregnated for delayed recovery, which forms the low region, being built up in a tiered manner by a second foam sealing strip that is impregnated for delayed recovery, the first foam sealing strip being adhesively bonded to the second foam sealing strip, and the first foam sealing strip, which forms the low region, having a base surface with a planar profile and extending over the entire width, the first and second foam sealing strips being a compressible material that is compressible under a pressure and that recovers to the recovered state when the pressure is released, the impregnation of the first and second foam sealing strips causing the delayed recovery to the recovered state when the pressure is released, and the first and second foam sealing strips being adapted to be compressed in a uniform sealing gap between two surfaces in a final assembled state, such that the high region, the low region, and the curved surface profile have substantially the same heights when the foam sealing strips are compressed between the two surfaces in the final assembled state, and a permanent compression of the foam sealing strip is greater in the high region at the narrow side than in the low region at the narrow side, thereby creating a desired lower vapor permeability from the high region to the low region.

3. A foam sealing strip impregnated for delayed recovery, the foam sealing strip, comprising:

two opposite narrow sides which, in the fitted state, respectively face the inner side and the outer side of a window frame; and wide sides suitable for respectively abutting a window frame and a reveal in a recovered state, at least one edge region of the cross-section, formed as a high region, having a greater height from a base surface, provided on the wide side, than a low region, adjoining in a direction of a width, the high region and the low region running in alignment with a longitudinal direction, and a tiered surface profile being provided, in the recovered state, two edge regions of the cross-section being formed as high regions having a greater height than a low region located between the high regions in the direction of the width, respective surface profiles between each of the high regions and the low region being curved in cross-section to form the high region and the low region as a single and unitary part, the high regions and the low region running in alignment with the longitudinal direction and a height of the low region being between 60% and 80% of the height of the high region, and the low region having a dimension which is one-tenth to four-tenths of the dimension of one of the wide side, a foam of the foam sealing strip being a compressible material that is compressible under a pressure and that recovers to the recovered state when the pressure is released, the foam being impregnated for delayed recovery to the recovered state when the pressure is released, the foam sealing strip being adapted to be compressed in a uniform sealing gap between two surfaces in a final assembled state, such that the high regions, the low region, and the curved cross-section have substantially the same heights when the foam sealing strip is compressed between the two surfaces in the final assembled state, and a permanent compression of the foam sealing strip is greater in the high regions at the narrow sides than in the low region between the high regions, thereby creating a desired lower vapor permeability from the high regions to the low region.

4. The foam sealing strip as set forth in claim 3, wherein at least one of the greater height of the high region is taken from a planar base surface and a curved surface profile is provided as a line of curvature with a point of inflection in cross-section.

5. The foam sealing strip as set forth in claim 4, wherein at least one of a scrim is disposed in the bonding region of the first foam sealing strip to the second foam sealing strip, and the first foam sealing strip and the second foam sealing strip being made such that they are differently colored.

6. The foam sealing strip as set forth in claim 5, wherein at least one of a side surface of the second foam sealing strip is in alignment with a side surface of the first foam sealing strip, and both foam sealing strips have a rectangular cross-section.

7. The foam sealing strip as set forth in claim 5, wherein the sealing strip is formed symmetrically with respect to a center plane extending transversely in relation to a wide side.

8. The foam sealing strip as set forth in claim 7, wherein in the recovered state the height of the low region corresponds to 60% to 70% of the height of the high region.

9. The foam sealing strip as set forth in claim 8, wherein the sealing strip has in cross-section a U-profile that results in a central depression.

10. The foam sealing strip as set forth in claim 9, wherein:

in the high region, a fully recovered height of the foam sealing strip is half to one and a half times the width of the sealing; and if the foam sealing strip includes two high regions, the fully recovered height of the foam sealing strip is one-quarter to three-quarters of the width of the sealing strip.

11. The foam sealing strip as set forth in claim 10, wherein the foam sealing strip has in a packed state a substantially uniform compression over its width, the uniform compression in the packed state being achieved by an insert part associated with the low region, the insert part at least one of being formed as a strip and including a biodegradable material.

12. The foam sealing strip as set forth in claim 11, wherein the insert part is a foam.

13. The foam sealing strip as set forth in claim 12, wherein the uniform compression over the width is achieved by two foam sealing strips disposed such that they overlap one another at least partially and are directed in opposite directions, the foam sealing strips being of the same form.

14. The foam sealing strip as set forth in claim 13, wherein the insert part formed as a foam part is formed as a hinge-connected part of the foam sealing strip.

15. The foam sealing strip as set forth in claim 14, wherein the insert part is formed by a separating cut that does not cut through the foam sealing strip.

16. A foam sealing strip impregnated for delayed recovery, the foam sealing strip, comprising:

two opposite narrow sides which, in the fitted state, respectively face the inner side and the outer side of a window frame; and wide sides suitable for respectively abutting a window frame and a reveal in a recovered state, at least one edge region of the cross-section, formed as a high region, having a greater height from a base surface, provided on the wide side, than a low region, adjoining in a direction of a width, the high region and the low region running in alignment with a longitudinal direction, and a tiered surface profile being provided, in the recovered state, two edge regions of the one-piece cross-section being formed as high regions having a greater height than a low region located between the high regions in the direction of the width, respective surface profiles between each of the high regions and the low region being curved in cross-section to form the high region and the low region as a single and unitary part, the high regions and the low region running in alignment with the longitudinal direction and a height of the low region being between 60% and 80% of the height of the high region, the low region having a dimension which is one-tenth to four-tenths of the dimension of one of the wide sides, a foam of the foam sealing strip being a compressible material that is compressible under a pressure and that recovers to the recovered state when the pressure is released, the foam being impregnated for delayed recovery to the recovered state when the pressure is released, the foam sealing strip being adapted to be compressed in a uniform sealing an between two surfaces, such that a compressed height along the cross-section between the opposite narrow sides is substantially the same during a final assembled state when both of the high regions and the low region are in a compressed state, and a permanent compression of the foam sealing strip is greater in the high region at the narrow side than in the low region at the narrow side, thereby creating a desired lower vapor permeability from the high region to the low region.

17. A window frame assembly, comprising:

a window frame;

a reveal substantially parallel to a side of the window frame between an inner side of the window frame and an outer side of the window frame; and an impregnated foam sealing strip for sealing between the window frame and the reveal, the foam sealing strip comprising:

two opposite narrow sides, defining a height, that in a fitted state, respectively, face one of the inner side and the outer side of the window frame; and two wide sides, defining a width, abutting the side of the window frame and the reveal, respectively, in a recovered state, at least one of the narrow sides being formed as a high region having a greater height from a base surface on one of the wide sides than a height of a low region, the high region and the low region being joined in a direction of the width, the high region and the low region running in alignment with a longitudinal direction of the foam sealing strip and, in the recovered state, a surface profile which is curved in cross-section and formed in a tiered manner between the high region and the low region being provided on the surface opposite from the base surface to form the high region and the low region as a single and unitary part, and the base surface being a planar surface and extending over the entire width, the foam sealing strip being a compressible material that is compressible under a pressure and that recovers to the recovered state when the pressure is released, the foam being impregnated for delayed recovery to the recovered state when the pressure is released, the base surface being formed by the impregnated foam, the low region height being between 60% and 80% of the high region height so that a height of the curved surface profile is between 40% and 20% of the height of the high region, and the low region having a dimension which is one-tenth to four-tenths of the width of the wide sides, the foam sealing strip being adapted to be compressed in a uniform sealing gap between two surfaces in a final assembled state, the such that the high region, the low region, and the curved surface profile have substantially the same heights when the foam sealing strip is compressed between the two surfaces in the final assembled state, and a permanent compression of the foam sealing strip is greater in the high region at the narrow side than in the low region at the narrow side, thereby creating a desired lower vapor permeability from the high region to the low region.

* * * * *